US009062517B2

(12) United States Patent
Edwards et al.

(10) Patent No.: US 9,062,517 B2
(45) Date of Patent: Jun. 23, 2015

(54) WELL CONTAINMENT SYSTEM

(75) Inventors: Jeffrey Charles Edwards, Aberdeenshire (GB); Michael Graham Morgan, Aberdeenshire (GB)

(73) Assignee: ENOVATE SYSTEMS LIMITED, Aberdeen (GB)

( * ) Notice: Subject to any disclaimer, the term of this patent is extended or adjusted under 35 U.S.C. 154(b) by 296 days.

(21) Appl. No.: 13/498,933

(22) PCT Filed: Sep. 30, 2010

(86) PCT No.: PCT/GB2010/001835

§ 371 (c)(1),
(2), (4) Date: May 17, 2012

(87) PCT Pub. No.: WO2011/039512

PCT Pub. Date: Apr. 7, 2011

(65) Prior Publication Data

US 2012/0217020 A1 Aug. 30, 2012

(30) Foreign Application Priority Data

Oct. 1, 2009 (GB) ..... 0917210.7
Oct. 23, 2009 (GB) ..... 0918591.9

(51) Int. Cl.
*E21B 33/064* (2006.01)
*E21B 19/10* (2006.01)

(52) U.S. Cl.
CPC ..... *E21B 33/064* (2013.01); *E21B 19/10* (2013.01)

(58) Field of Classification Search
CPC ..... E21B 33/06; E21B 33/061; E21B 33/062; E21B 33/063
USPC ..... 166/363, 361, 368, 85.4, 86.1, 86.2, 166/84.3; 137/315.02; 251/1.1–1.3; 277/324, 325, 332
See application file for complete search history.

(56) References Cited

U.S. PATENT DOCUMENTS

| | | | | |
|---|---|---|---|---|
| 4,046,191 | A * | 9/1977 | Neath | 166/352 |
| 5,848,656 | A * | 12/1998 | Møksvold | 175/7 |
| 5,860,478 | A * | 1/1999 | Coutts et al. | 166/356 |
| 5,875,848 | A * | 3/1999 | Wolff et al. | 166/345 |
| 6,230,824 | B1 | 5/2001 | Peterman et al. | |
| 6,253,854 | B1 * | 7/2001 | Fenton | 166/364 |
| 6,321,846 | B1 * | 11/2001 | Rytlewski | 166/363 |
| 6,470,975 | B1 | 10/2002 | Bourgoyne et al. | |
| 6,484,816 | B1 * | 11/2002 | Koederitz | 175/25 |
| 7,062,960 | B2 * | 6/2006 | Couren et al. | 73/152.51 |
| 7,134,498 | B2 * | 11/2006 | Hopper | 166/357 |
| 7,274,989 | B2 * | 9/2007 | Hopper | 702/6 |
| 7,921,917 | B2 * | 4/2011 | Kotrla et al. | 166/339 |
| 2005/0061499 | A1 * | 3/2005 | Hopper | 166/84.3 |
| 2008/0105435 | A1 * | 5/2008 | Inderberg | 166/363 |
| 2009/0101411 | A1 | 4/2009 | Hannegan et al. | |

* cited by examiner

*Primary Examiner* — Matthew Buck
(74) *Attorney, Agent, or Firm* — Tarolli, Sundheim, Covell & Tummino LLP

(57) ABSTRACT

A well containment system is described, the system comprises a blow out preventer, the blow out preventer defining a throughbore and including at least one well containment barrier adapted to seal the throughbore, at least one first seal adapted to seal against the lower end of a riser, and at least one second seal adapted to seal against the upper end of a downhole tubular wherein the at least one first seal is located above the at least one well containment barrier and the at least one second seal is located below the at least one well.

30 Claims, 13 Drawing Sheets

WELL CONTAINMENT SYSTEM

FIELD OF THE INVENTION

The present invention relates to a well containment system for use with subsea wells.

BACKGROUND TO THE INVENTION

Drilling a well, and the subsequent completion operation, involves accessing a pressurised reservoir via a drilled bore. The primary means by which reservoir fluids from a well are prevented from escaping into the environment is by imposing a hydrostatic pressure on the well. This pressure is known as the primary barrier and is created by introducing an artificial fluid, mud or brine into the well during drilling or completion operations, through a marine riser which extends from the seabed to a surface vessel. The specific gravity or density of this fluid can be adjusted by careful control of the constituents making up the fluid mixture, which add or subtract weight to control the specific gravity. In this way the hydrostatic pressure can be adjusted to suit a particular well conditions, independent of the length of the fluid column between the surface and the reservoir.

Sometimes, the subterranean reservoir formation is weak and for this reason it is necessary to maintain the hydrostatic pressure at a minimum in order to prevent fracturing the formation. If fracturing occurs, fluids within the column can be lost into the formation which results in a reduction in the height of the fluid column and may lead to a situation in which the hydrostatic pressure becomes less than the well pressure. Particularly, in the case of drilling operations, if the well pressure exceeds the hydrostatic pressure there exists a possibility of losing control of the well. Initially this is felt as a "kick" in which well fluids begin to come to the surface slowly. If a kick is not detected immediately the well can quickly become out of control and is known in this state as a "blow out".

To contain the well, a well containment system is provided between the marine riser and the wellhead. The well containment system comprises a secondary barrier system of invokeable seals on hydraulic rams installed onto the wellhead. The rams can be actuated to close in and seal the well. In order to do so whilst pipe is in the well, at least one of these rams is able to cut the drill pipe or other well tubulars, and seal the well to allow well control to be established. This part of the well containment system is known as the blow out preventer system. During completion operations the tool strings are passed down through the marine riser and well containment system into the well to allow downhole operations to be performed. In the event of a blow out, the rams have to be able to sever through the drill string, or, during completion operations, a high pressure internal riser and the tool string contained therein. In some cases this operation has either not been performed successfully because, for example, the high pressure riser is too tough for the blow out preventer rams to shear through.

Furthermore, when the tubular is sheared, the part of the tubular in the well drops downhole. Once it is safe to reconnect to the well, it is necessary to regain well control and to retrieve the dropped pipe. This combination of tasks is difficult and time consuming.

The marine riser is a large bore, low-pressure pipe which conducts the returning drilling fluid back to the mud storage system at surface. The well containment system also comprises an emergency disconnect package which is positioned between the bottom of the marine riser and the blow out preventer. The emergency disconnect package, which facilitates disconnection of the riser, isolates the marine riser from well fluids.

Two other conduits, known as the choke and kill lines, are strapped to the low-pressure marine riser. These are capable of withstanding high pressure and are used in the circulation of high-pressure fluids during the re-establishment of well pressure control.

The lines are connected to pipe pressure manifolds on the surface. The kill line is hooked up to the outlet of a high pressure pump and the choke line is hooked up to a high pressure choke which drops the pressure and allows fluids to return controllably to the mud storage system.

In deep water, the back pressure in the choke and kill lines becomes excessive to the extent it can become unacceptable. The increased length of these small bore lines creates a significant pressure increase due to friction and this can, in turn, apply a pressure to the well which may result in unnecessary formation breakdown. This problem has led to the development of a dual stack system, which includes a simplified blow out preventer stack with a disconnectable lower marine riser package attached to the wellhead. The lower marine riser package is connected to a large bore, high-pressure riser, the top end of which is connected to a near surface BOP stack, which in turn is attached to a short marine riser to surface.

A large bore, high-pressure riser is very costly and the cost increases dramatically with the increase in pressure and depth of water. As the size, complexity and weight of these systems increases the practicality for deployment of the systems from a surface facility, conventionally a ship, barge or rig, decreases.

SUMMARY OF THE INVENTION

According to a first aspect of the present invention there is provided a well containment system comprising:

a blow out preventer, the blow out preventer defining a throughbore and including at least one well containment barrier adapted to seal the throughbore;

at least one first seal adapted to seal against the lower end of a riser; and at least one second seal adapted to seal against the upper end of a downhole tubular;

wherein the at least one first seal is located above the at least one well containment barrier and the at least one second seal is located below the at least one well containment barrier.

In an embodiment of the present invention the use of seals obviates the need for the high-pressure riser and the downhole tubular to be directly connected. When they are not directly connected, and the well containment barrier is positioned in the gap between the riser lower end and the downhole tubular upper end, the well containment barrier, when activated, does not need to shear through a tubular to seal the well. This is particularly useful during completion operations in which a tool string has been lowered into the well because to secure the well, the well container barrier only has to sever through the tool string and not through both the high pressure riser and the tool string. This provides for a more reliable solution.

In use, the upper end of a downhole tubular may be located below the well containment barrier.

In use, the lower end of the riser may be located above the well containment barrier.

The/each well containment barrier may comprise at least one shearing mechanism adapted to shear a tubular.

The/each well containment barrier may comprise at least one ram adapted to seal the blow out preventer throughbore.

The/each well containment barrier may comprise a pair of rams.

There may be a plurality of well containment barriers.

Where there is a plurality of well containment barriers, the at least one first seal may be located above the uppermost well containment barrier.

Where there are a plurality of well containment barriers, the at least one second seal may be located below the lowest well containment barrier.

There may be an upper well containment barrier and a lower well containment barrier.

The at least one first seal may be located above the upper well containment barrier.

The at least one second seal may be located below the lower well containment barrier.

The at least one first seal may be an annular seal.

The at least one first seal may comprise a seal element adapted to move between a retracted position and a sealing position in which, in use, is sealed against the lower end of a riser.

The at least one first seal seal element may be adapted to move radially inwardly between the retracted and sealing positions.

There may be a plurality of first seals. A plurality of first seals may be provided to ensure there is at least one back up seal in thee vent of failure of one of the first seals.

The at least one second seal may be an annular seal.

The at least one second seal may comprise a seal element adapted to move between a retracted position and a sealing position in which, in use, it is sealed against the upper end of a downhole tubular.

The at least one second seal element may be adapted to move radially inwardly between the retracted and sealing positions.

The at least one second seal element may be adapted to withstand pressure from above and below.

There may be a plurality of second seals.

At least one of the plurality of second seals may be adapted to withstand pressure from below.

At least one of the plurality of second seals may be adapted to withstand pressure from above.

Each at least one first and at least one second seal may comprise a housing.

The housing may define an opening.

The seal element may be adapted to inflate or expand through the opening.

The opening may face into the well containment system throughbore.

According to a second aspect of the present invention there is provided a well containment system comprising:

a blow out preventer having a choke line lower portion;

an emergency disconnect package having a choke line upper portion; and a latch for releasably connecting the emergency disconnect package to the blow out preventer;

wherein the latch is configured to permit the choke line portions to be in fluid communication when said choke line portions are non-aligned.

By non-aligned it is meant that the longitudinal axis of an upper choke line portion is not co-axial with the longitudinal axis of a lower choke line portion when the upper and lower choke line portions are parallel to the well containment system throughbore axis.

In one embodiment of the present invention, providing a latch which permits fluid communication between the choke lines, facilitates deployment of the emergency disconnect package onto the blow out preventer as they can be connected without having to adopt a specific orientation. In prior art systems a specific orientation has to be adopted to ensure the upper and choke line portions engage.

The latch may comprise an upper member and lower member.

The upper and lower latch members may be releasably connectable.

The upper and lower latch members may define a throughbore.

When the upper and lower latch members are connected, the upper member throughbore and the lower member throughbore may be aligned.

One of the upper latch member and lower latch member defines a male portion and the other of the upper latch member and lower latch member defines a female portion.

The latch members may be adapted to connect in a plurality of relative orientations. In this embodiment as long as the latch member throughbores are aligned, the latch members can connect in more than one relative orientation.

The latch members may be adapted to connect in an infinite number of orientations. As long as the latch member throughbores are aligned, the latch members can connect in any relative orientation.

The lower latch member may define a port adapted to connect to the choke line lower portion.

The upper latch member may have a port adapted to connect to the choke line upper portion.

The upper latch port and the lower latch port may be in fluid communication.

Fluid communication may be provided through a conduit.

The conduit may comprise conduit sections.

The upper latch member may define an upper latch conduit section.

The lower latch member may define a lower latch conduit section.

When connected the upper and lower latch members are engaged at an interface.

At the interface the upper latch conduit section and the lower latch conduit section may define an upper latch conduit section inlet and a lower latch conduit section outlet respectively.

The inlet and outlet may be adapted to be in fluid communication in more than one orientation of the upper and lower latch members.

At least one of the upper latch inlet and lower latch outlet define a continuous slot.

The continuous slot may be circular.

The continuous slot may be annular.

The continuous slot may be concentric with the latch throughbore. An inlet/outlet which encircles the throughbore allows for latch portions to be connected in any orientation.

The interface may comprise at least one seal.

The seal may be adapted to prevent leakage from the outlets.

According to a third aspect of the present invention there is provided a well containment system comprising:

a blow out preventer;

an emergency disconnect package;

a subsea choke; and a choke inlet line adapted, in use, to provide a fluid conduit from a well annulus to the choke.

In one embodiment, by providing a subsea choke the pressure in the choke line can be reduced at the well and fed into the low-pressure marine riser. This overcomes the problem of severe backpressure, which is encountered with choke lines which extend back to surface, in deep water, where the length of the line causes severe back pressure.

The subsea choke may be adjacent the emergency disconnect package.

The subsea choke may be adjacent the well containment system.

The well containment system may further provide a choke outlet line.

The choke outlet line may be adapted to provide a fluid conduit, in use, from the subsea choke to a marine riser.

The choke outlet line may provide a fluid conduit directly into the marine riser.

The choke outlet line may access the marine riser through the emergency disconnect package.

The choke outlet line may, in use, access the marine riser at or adjacent the lower end of the marine riser. The emergency disconnect package and subsea choke may be adapted to be lowered from a vessel to a seabed on the end of a marine riser.

According to a fourth aspect of the present invention there is provided an apparatus for suspending a tubular within the bore of a well containment system, the apparatus comprising:

a housing defining a throughbore aligned with the bore of said well containment system and adapted to receive said tubular; and a gripping mechanism for gripping the tubular, the gripping mechanism being moveable between a retracted, non-engaged configuration and an engaged configuration, the gripping mechanism, in use, when in said engaged configuration applying a gripping force to the tubular;

and wherein, when said gripping mechanism is engaged with a tubular, downward movement of the tubular faces causes the gripping mechanism to move into a tighter engagement with the tubular, thereby increasing the gripping force applied to said tubular.

In one embodiment, an apparatus according to the present invention can be used to prevent a severed tubular falling downhole. In an emergency situation where a floating vessel has to pull away from the wellhead, or is forced to do so by, for example, weather conditions or as a means of releasing from a tubular which has become stuck in the well, the tubular can be severed by the BOP cutters and the apparatus activated to secure the tubular. This allows faster recovery of the situation and a return to operations more quickly with the associated cost savings.

In an embodiment, the gripping mechanism is rotationally moveable between the non-engaged and engaged configurations.

In an embodiment, in the engaged configuration, the gripping mechanism forms a rolling engagement with the tubular.

The gripping mechanism may be adapted to form an engagement with an external tubular surface.

The gripping mechanism may define at least one contact surface for engaging the tubular.

The contact surface may be profiled.

The profile may be sharp edged.

The profile may be serrations teeth, spikes or the like.

The profile may be defined by particles attached to the/each contact surface.

The particles may be harder than the/each contact surface.

The particles may be attached to the/each contact surface by welding, brazing, soldering, adhesively bonded to attached in any suitable way.

The profile may be selected such that the coefficient of friction between the tubular and the gripping mechanism is maximised. Maximising the coefficient of friction improves the gripping performance of the gripping mechanism.

The profile may be chosen to increase, in use, the surface area in contact with the tubular.

The gripping mechanism profile may bite into the tubular.

The gripping mechanism may be rotationally mounted to the housing.

In one embodiment the gripping mechanism is pivotally mounted to the housing.

The gripping mechanism may be adapted to pivot or rotate around a rotation axis.

The gripping mechanism may comprise a plurality of gripping devices.

Each gripping device may be adapted to rotate or pivot around its own rotation axis.

In the engaged configuration, the gripping mechanism may be adapted to centre the tubular within a wellbore.

The gripping mechanism may comprise a plurality of fingers.

Each finger may comprise a first end and a second end.

Each finger may define a contact surface for contacting the tubular.

Each finger first end may define the contact surface.

Each finger may be pivotally mounted to the housing.

Each finger second end may be pivotally mounted to the housing.

Each finger may be biased towards the engaged configuration.

Each finger may be biased by means of its own weight towards the engaged configuration.

The gripping mechanism may comprise at least one biasing device to bias each finger towards the engaged configuration.

The at least one biasing device may be resilient.

The biasing device may comprise a spring.

The spring may be a compression spring, leaf spring, coil spring or any suitable spring.

The biasing device may comprise a camming mechanism.

In an alternative embodiment, the gripping mechanism may comprise a plurality of eccentrically-shaped rollers.

In moving from the retracted to the engaged configuration, the gripping mechanism may move radially inwardly.

In the retracted configuration the gripping mechanism that may define a first internal diameter.

In the engaged configuration the gripping mechanism may define a second internal diameter, the first internal diameter being greater than the second internal diameter.

The internal diameter may decrease as the gripping mechanism rotates. This arrangement adds utility to the device. As the diameter defined by the gripping mechanism decreases, the gripping mechanism can be used to grip different diameters of tubular.

In one embodiment, the gripping mechanism may rotate as each gripping mechanism finger pivots.

The internal diameter may be defined by the gripping mechanism contact surface(s).

The apparatus may comprise an actuation device.

The actuation device may be adapted to move the gripping mechanism between the retracted and engaged configurations.

The actuation device may be adapted to apply a force to the gripping mechanism.

The actuation device may be adapted to apply an engaging force to the gripping mechanism to move the gripping mechanism from the retracted to the engaged configurations.

The actuation device may be adapted to apply a disengaging force to the gripping mechanism to move the gripping mechanism from the engaged to the retracted configurations.

The actuation device may be axially moveable with respect to a housing throughbore axis.

In one embodiment axial movement of the actuation device causes rotational movement in the gripping mechanism.

In the preferred embodiment, axial movement of the actuation causes the gripping mechanism to pivot.

Axial movement of the actuation device may cause each gripping member finger to pivot.

In one embodiment the actuation device restrains the gripping mechanism such that the gripping mechanism moves from the retracted to the engaged configuration in a predetermined plane.

The predetermined plane may pass through the housing throughbore axis.

The actuation device may be a piston.

The piston may be hydraulically operated.

The piston may be hydraulically operated between a first position in which the gripping mechanism is in the retracted configuration and a second position in which the gripping mechanism is in the engaged configuration.

In one embodiment, the piston comprises a plurality of apertures, each aperture adapted to permit a finger to pass therethrough.

In an alternative embodiment, the piston may be castellated.

Each castellation may be adapted to pass through an aperture defined by a gripping mechanism finger. An aperture arrangement, whether defined by the gripping mechanism or the actuation device, assists in maintaining the movement of each gripping mechanism from the retracted to the engaged configurations in a plane which passes through the wellbore longitudinal axis. Restraining each finger in this way prevents it from deviating away from the tubular upon contact with the tubular.

The apparatus may comprise at least one securing device.

In one embodiment the securing device(s) is adapted to retain the actuation device in the first position.

In one embodiment the securing device(s) is a valve adapted to maintain hydraulic pressure on the piston when the piston is in the first position.

The valve may be a one way valve.

The valve may be overridden.

In an alternative embodiment, the securing devices may be a plurality of dogs.

Each dog may be adapted to engage a recess defined by the piston.

The recess(s) may be located such that when engaged with a dog, the piston is in the first position.

The dogs may be biased to a contact position in which each dog is engaged with the piston recess. Each dog may be biased by means of a spring or camming mechanism.

The dogs may be disengaged from the piston by the application of a hydraulic pressure.

In an alternative embodiment, the securing device(s) may be one or more biased split rings.

The housing may define an inlet port and an outlet port.

The inlet port and the outlet port may be adapted to be connected to the choke and kill lines of a blow out preventer The apparatus may be adapted to be located within a blow out preventer.

The apparatus may be adapted to be located within a wellhead adjacent a blow out preventer or Christmas tree According to a fifth aspect of the present invention there is provided a well containment system, the apparatus comprising:

a blow out preventer adapted to shear a tubular; and a gripping mechanism for gripping the tubular, the gripping mechanism being moveable between a retracted, non-engaged configuration and an engaged configuration, the gripping mechanism, in use, when in said engaged configuration, applying a gripping force to the tubular;

wherein, when said gripping mechanism is engaged with a tubular, downward movement of the tubular causes the gripping mechanism to move into a tighter engagement with the tubular, thereby increasing the gripping force applied to said tubular.

According to a sixth aspect of the present invention there is provided a method of killing a well when a cut tubular is suspended in a well containment system, the method comprising the steps of:

opening at least one well containment barrier to expose the open top of said cut downhole tubular, the well containment barrier and the downhole tubular being vertically aligned;

pressurising a fluid to a pressure sufficient to overcome well pressure; and pumping said pressurised fluid through the well containment barrier into the downhole tubular.

The method may further comprise the step of pumping the fluid from a surface vessel to the well containment barrier down a marine riser.

In one embodiment, such a method obviates the need for a kill line separate from the marine riser.

According to a seventh aspect of the present invention there is provided a method of controlling a well, the method comprising the steps of:

severing a tubular by a well containment barrier; and retaining a first severed tubular portion above the well containment barrier and suspending a suspending a second severed tubular portion below the well containment barrier such the upper end of the second severed tubular portion is open.

Leaving the upper end of the second severed tubular open permits the killing fluid to be pumped down the well through the open end of the severed tubular.

According to a eighth aspect of the present invention there is provided a method of containing a well during a completion operation, the method comprising:

actuating a well containment barrier to sever an exposed section of tool string.

According to a ninth aspect of the present invention there is provided a method of suspending a tubular in a wellbore, the method comprising the step of:

actuating a gripping mechanism in response to a signal that said tubular has been severed, to move from a retracted non-engaged position to an engaged position, the gripping mechanism in the engaged position applying a gripping force to the severed tubular such that downward movement of the tubular causes the gripping mechanism to move into tighter engagement with the tubular, thereby increasing the gripping force on said severed tubular.

The method may further comprise the step of shearing a tubular with a shearing device.

The method may further comprise the step of pumping a first fluid through an inlet defined by a housing into the tubular.

The method may further comprise the step of pumping a second fluid out of an outlet defined by the housing.

The first fluid may be heavier than the second fluid.

The first fluid may be denser than the second fluid.

According to a tenth aspect of the present invention there is provided a choke for use with a well containment system, said choke adapted to be used in a subsea location.

It will be understood the features associated with one aspect may be equally applicable to any other aspect and have not been repeated for brevity.

BRIEF DESCRIPTION OF THE DRAWINGS

An embodiment of the present invention will now be described with reference to the accompanying drawings in which.

DETAILED DESCRIPTION OF THE DRAWINGS

Figure 1:
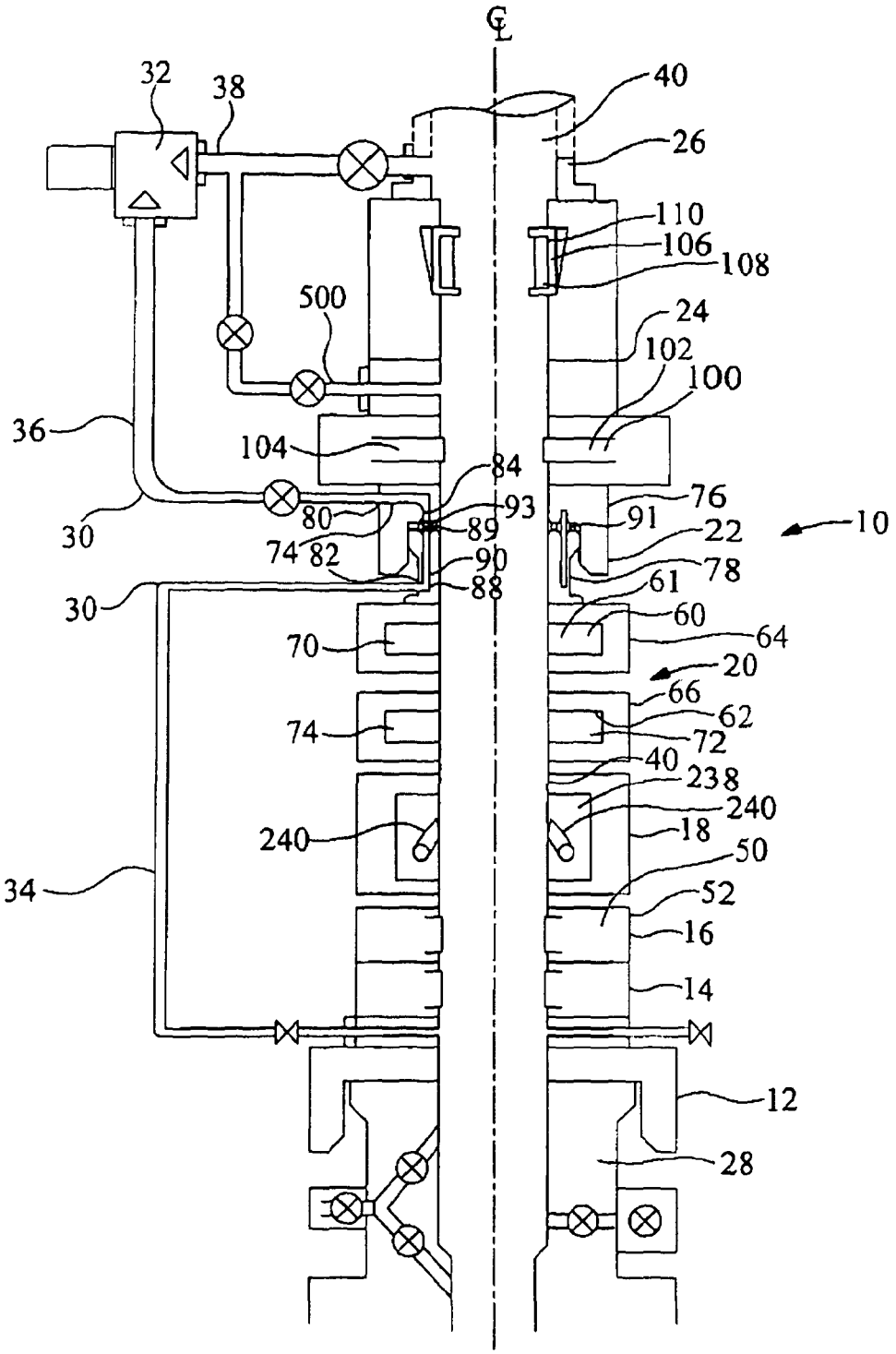
FIG. 1 is a section of a well containment system according to a first embodiment of the present invention.

Referring firstly to FIG. 1 there is shown a well containment system, generally indicated by reference numeral 10 according to a first embodiment of the present invention. The well containment system 10 comprises a connector 12, first and second lower annular seals 14,16, an apparatus for supporting a tubular in the form of a gripping apparatus 18, a blow out preventer 20, an orientable latch 22 and an emergency disconnect package 24. As can be seen from FIG. 1, the well containment system 10 is sandwiched between a low-pressure riser 26 and a horizontal Christmas tree 28, the connector 12 releasably connecting the well containment system 10 to the Christmas tree 28. The low pressure riser 26 extends from the well containment system 10 up to a surface vessel (not shown).

The well containment system 10 further comprises a choke line 30 running from beneath the first and second annular seals 14,16, through the orientable latch 22 and up to a subsea choke 32. The choke line 30 comprises a lower portion 34 associated with the blow out preventer 20 and an upper portion 36 associated with the emergency disconnect package 24. The subsea choke 32 has an outlet line 38, which feeds from the subsea choke 32 into the low-pressure riser 26.

The first and second lower annular seal 14,16 each comprise a seal element 50 contained within a housing 52. As will be described in due course, upon activation, the seal element 50 is adapted to move radially inwardly into a well containment system throughbore 40 to engage a tubular (not shown).

The tubular gripping apparatus 18 includes a gripping mechanism 238 in the form of six fingers 240 (two of which are shown). Each of the fingers 240 is rotationally moveable between a retracted configuration, in which the fingers 240 are displaced from a tubular passing through the well containment system 10, and an engaged configuration in which the fingers 240 apply a gripping force to the tubular. Operation of the tubular gripping apparatus 18 will be later described in detail.

The blow-out preventer 20 comprises an upper ram set 60 and a lower ram set 62. The upper ram set 60 comprises first and second rams 68, 70 and is contained within an upper ram housing 64. The lower ram set 62 comprises first and second rams 72, 74 is contained within a lower ram housing 66. The rams 68-74 in each ram set 60,62 are adapted to move into and seal the wellbore 40 when required.

The orientable latch 22 comprises an upper latch member 76 and a lower latch member 78, the upper latch member 76 being connected to the emergency disconnect package 24 and the lower latch member 78 being connected to the blow-out preventer 20.

Figure 15:
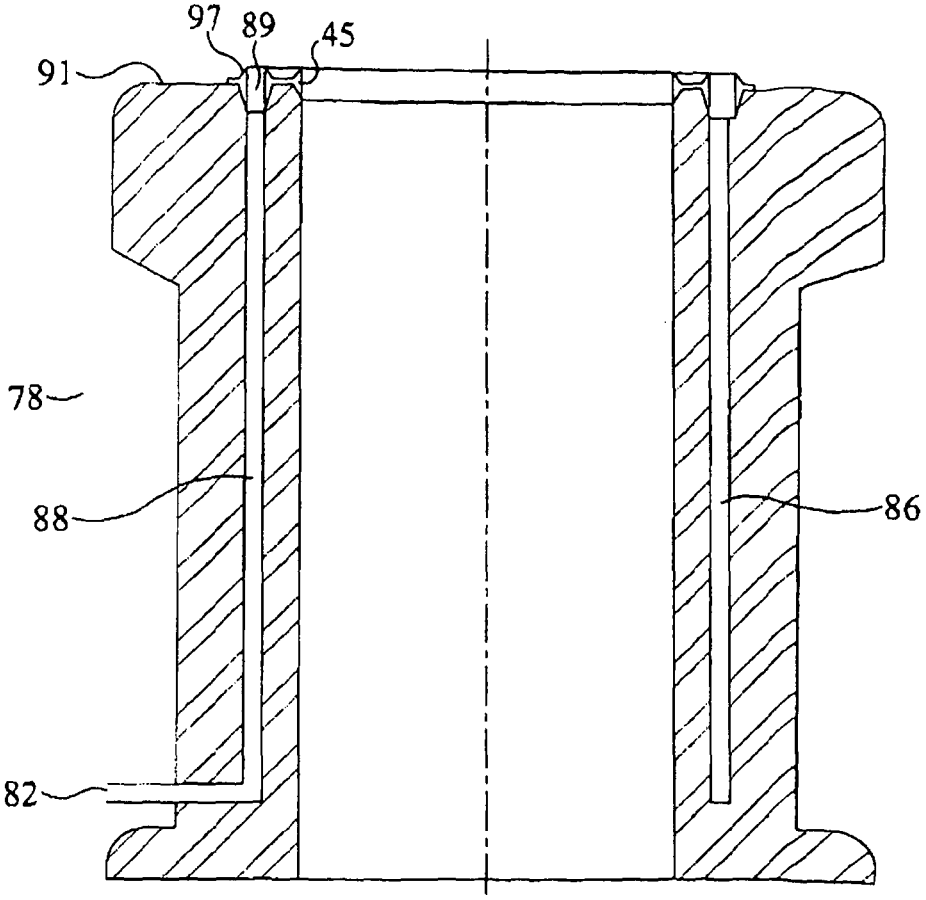
FIG. 15 is a part section taken on the lower latch member of the latch of FIG. 1.

The upper latch member 76 includes a port 80 for attachment to the upper choke line 36 and the lower latch member 78 includes a port 82 for connection to the lower choke line portion 34. Referring to FIG. 15, the lower latch member 78 defines a flow path 88 between the lower latch port 82 and a lower latch flow path outlet 89, the outlet 89 being a circular groove, concentric with the well containment system throughbore 40, defined by the lower latch member 78 at the interface 91 between the latch members 76,78. The lower latch member flow path 88 includes a vertical section 90, in the form of a plurality of drilled holes 86 which feed the pressurised fluid up the outlet groove 89.

Referring back to FIG. 1 the upper latch port 80 is in fluid communication with an upper latch member flow path 84 which is of similar construction to the flow path 88 of the lower latch member 78. The upper latch member 76 defines an inlet 93 in the form of a circular groove, concentric with the well containment system throughbore 40.

Figure 16:
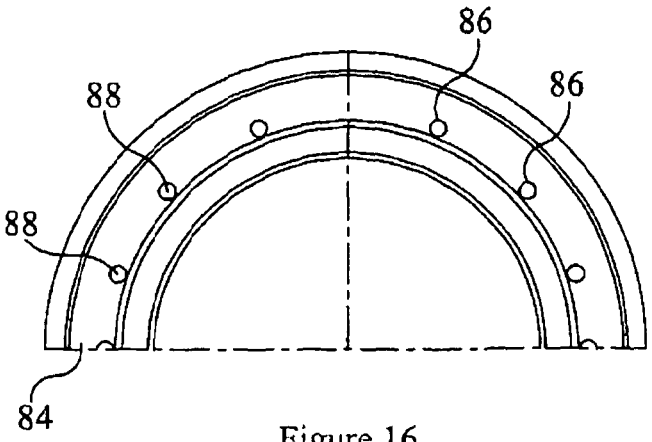
FIG. 16 is a plan view of half of the lower latch member shown in FIG. 15.

When the upper and lower latch members 76,78 are engaged, the lower latch member outlet 89 is aligned with the upper latch member inlet 93 and the flow path from the lower latch portion port 82 to the upper latch portion port 80 is continuous, regardless of the relative orientation of the latch portions 76,78. When the latch members 76,78 are engaged a pair of interface seals 95,97 (best seen in FIG. 16) prevent the leakage of fluid flowing from the lower latch member outlet 89 to the upper latch member inlet 93.

The emergency disconnect package 24 also includes a ram set 100 comprising first and second rams 102, 104 which are adapted to close and seal the well containment system throughbore 40. The emergency disconnect package 24 also includes an upper annular seal 106 adapted to seal against a tubular. The upper annular seal 106 comprises a seal element 108 housed within a housing 110 the seal element 108 being adapted to move radially inwardly to engage a tubular.

Figure 2:
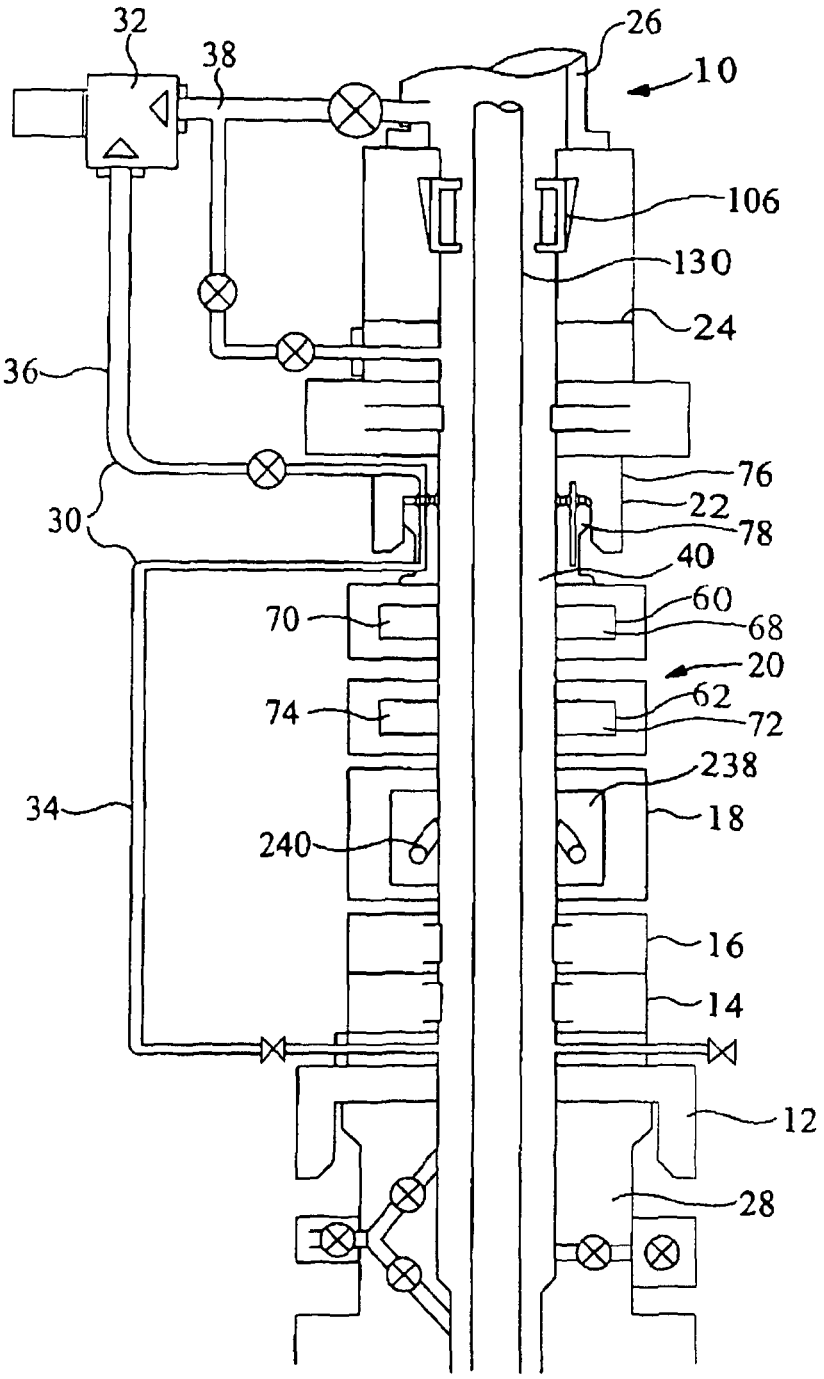
FIG. 2 is a section of the well containment system of FIG. 1 during a normal drilling operation.

The operation of the well containment system 10 in a number of modes will now be described. With reference to FIG. 2, the well containment system 10 is shown in normal use, during a drilling operation. In this operation, a drill string 130 passes through the well containment system throughbore 40. When a kick is detected, the well containment system 10 is activated by a hydraulic signal being sent down hydraulic control lines (not shown) from surface. Once activated the blow-out preventer ram sets 60, 62 are shut severing the drill string 130 into a lower portion 132 and an upper portion 134. Once the blow-out preventer rams 68-74 are shut, the upper drill string portion 34 is pulled up into the emergency disconnect package 24 by the vessel on surface (not shown) and the emergency disconnect package rams 102,104 are closed to seal the emergency disconnect package 24. The emergency disconnect package 24 can then be disconnected from the BOP 20 by separation of the upper latch member 76 from the lower latch member 78 and the vessel on surface (not shown) can be safely moved away from the well head 150.

In a conventional system, when the drill string 130 is severed, the lower drill string portion 132 would normally fall down and into the well however, provision of the gripping apparatus 18, which is also activated by a hydraulic signal from surface, permits the lower drill string portion 132 to be retained adjacent the blow-out preventer 20. Such a situation, shown in FIG. 3, facilitates re-establishing control of the well and resumption of normal activities as there is no need to fish for the lower drill string portion 132.

Figure 6:
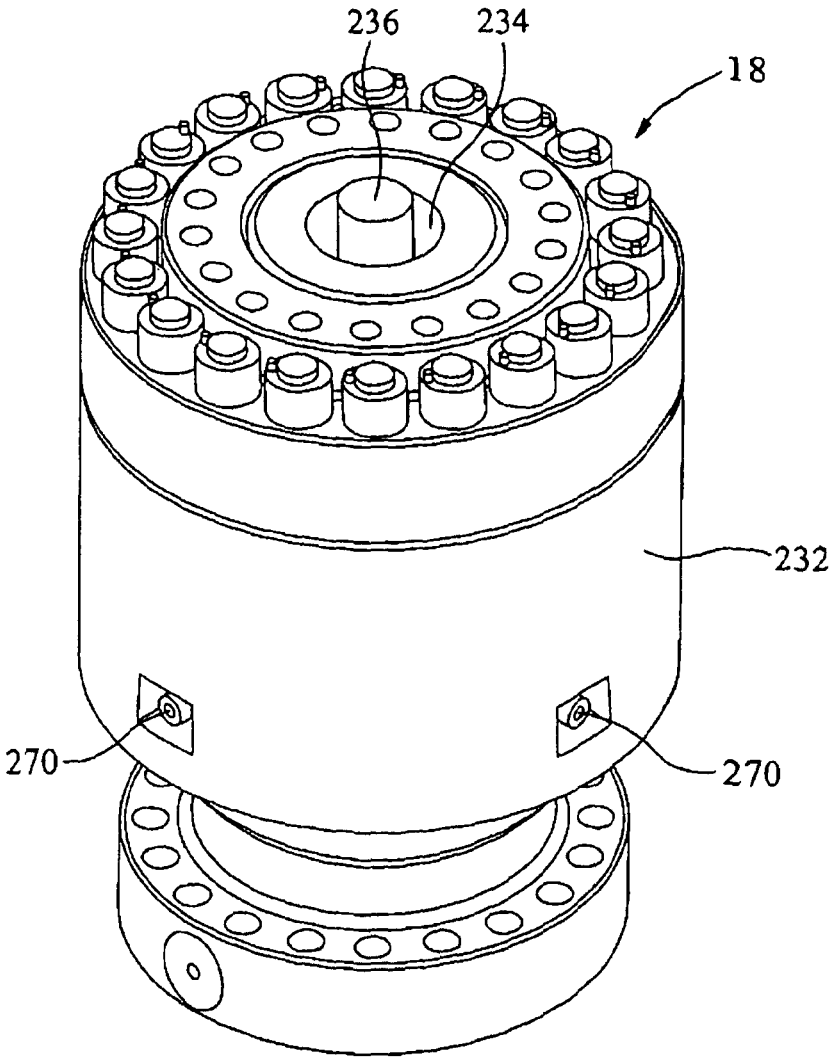
FIG. 6 is a perspective view of the apparatus for gripping a tubular of FIG. 1.
Figure 7:
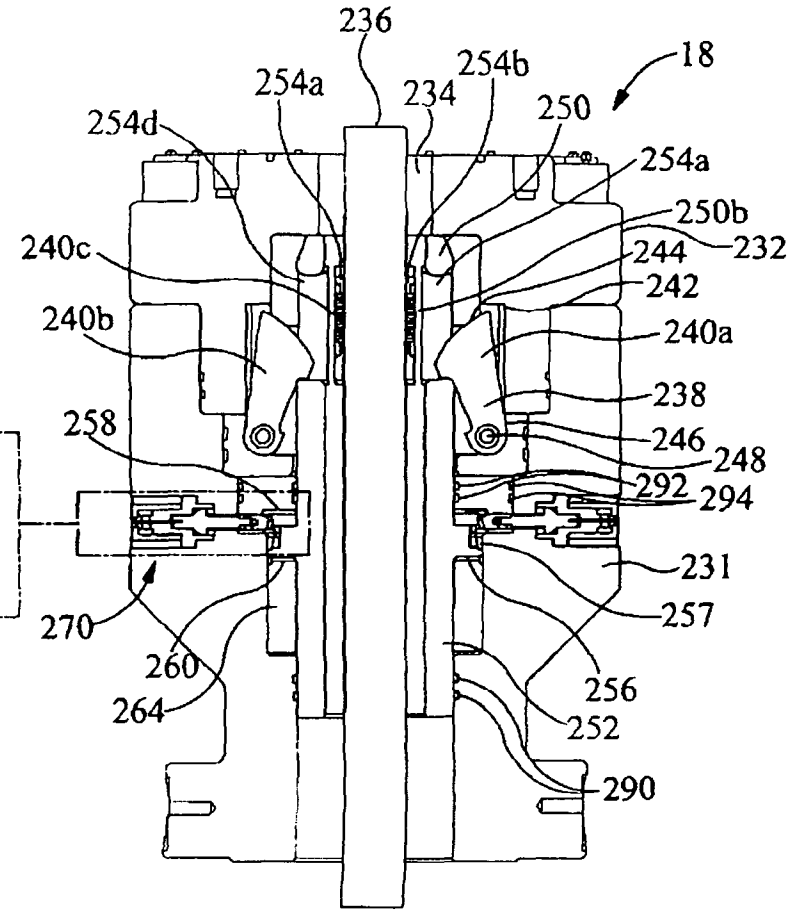
FIG. 7 is a section of the apparatus of FIG. 6 in a retracted configuration.

The operation of the gripping apparatus 18 will now be described. Referring now to FIGS. 6 and 7, which show respectively a perspective view and a sectional view of the gripping apparatus 18 for supporting a tubular, the apparatus 18 comprises a lower housing 231 and an upper housing 232, the upper and lower housings 231, 232 defining a throughbore 234 through which a tubular 236 can pass. The apparatus 18 further comprises a gripping mechanism 238 (FIG. 7) in the form of six fingers 240. Four of the fingers 240*a-d* are visible on FIG. 7. Each of the fingers 240 is rotationally moveable about a pivot 248 between a retracted configuration, in which the fingers 240 are not engaged with from the tubular 236 (FIG. 7), and an engaged configuration in which the fingers 240 apply a gripping force to the tubular 236 (Illustrated in FIG. 11 and discussed in due course).

Each finger 240 has a first end 242 defining a serrated surface 244 adapted to bite into the tubular 236, once engaged. Each finger 240 has a second end 246 pivotally mounted by means of the pivot 248 to the lower housing 231, such that in moving from the retracted to the engaged configuration, each finger 240 pivots about the pivot 248 with respect to the lower housing 231 in a radially inward direction. Such an arrangement means that once engaged with a tubular 236, downward movement of the tubular 236 due to the weight of the tubular 236, rotates the gripping mechanism 238 into a tighter engagement with the tubular 236 thereby increasing the gripping force.

Figure 9:
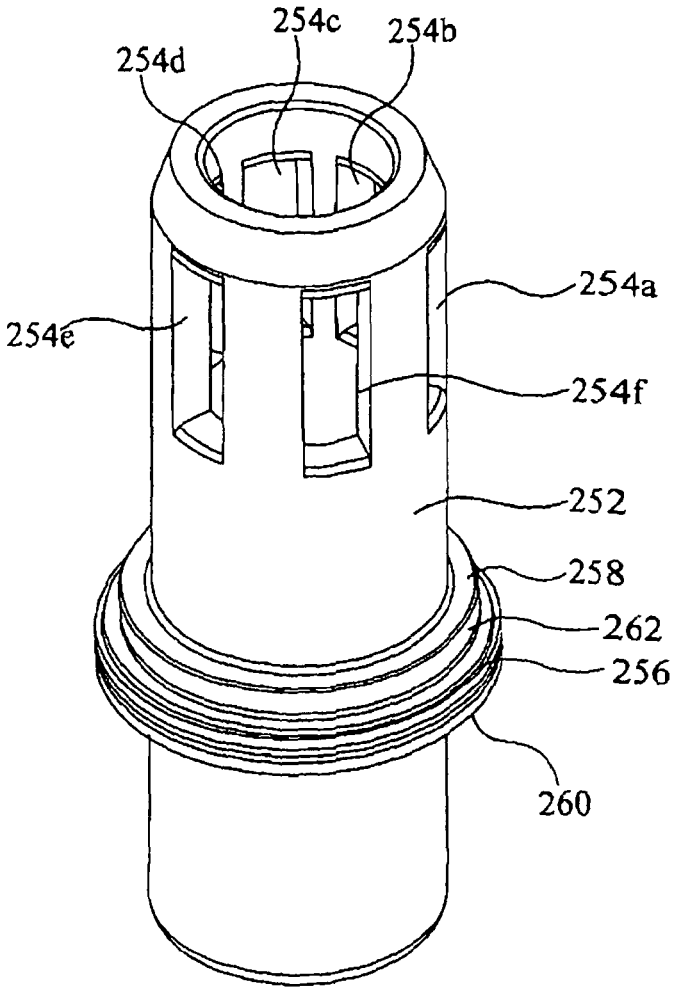
FIG. 9 is an enlarged perspective view of the piston rod of FIG. 7.

The apparatus 18 further comprises an actuation device 250 in the form of a hydraulically operated piston rod 252, best shown in FIG. 9, which is a perspective enlarged view of the piston rod 252. The piston rod 252 defines six finger apertures 254*a-f*, each aperture 254 adapted to receive and allow passage of a finger 240 therethrough.

The piston rod 252 further defines a piston 256 defining an upper surface 258, a lower surface 260 and a recess 262. The recess 262 can be seen most clearly in FIG. 11, a section of the apparatus of FIG. 6 shown engaged with a tubular 236.

Figure 11:
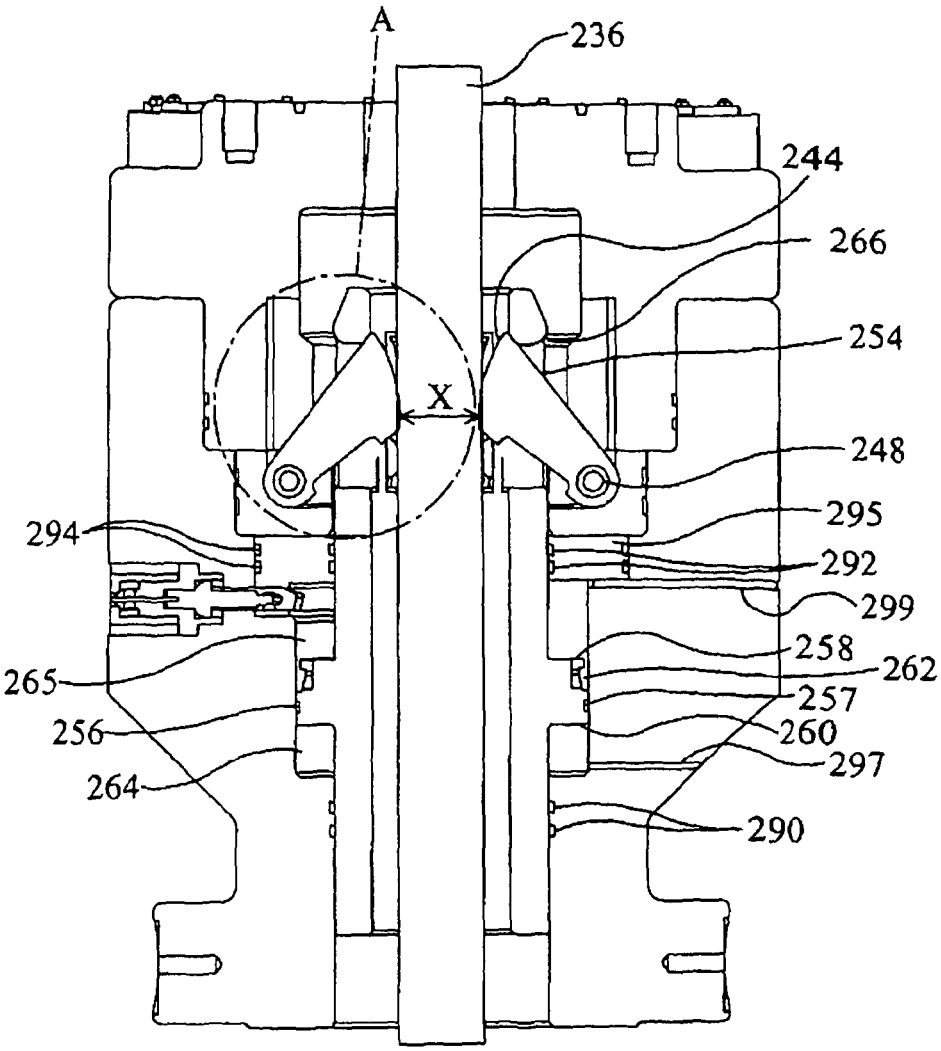
FIG. 11 is a section of the apparatus of FIG. 6 in an engaged configuration, shown engaged with a tubular having a diameter of 4.5 inches.

The purpose of the piston rod 252 is to retain the fingers 240 in the retracted configuration shown in FIG. 7. The piston rod 252 is adapted to move axially downwards with respect to the housing throughbore 234 from the position shown in FIG. 7 to the position shown in FIG. 11, the movement being due hydraulic fluid being pumped into a first and second chambers 264, 265. The first chamber 264 is sealed at the top by a piston seal 257 and at the bottom by fixed seals 290 (FIG. 11). The second chamber 264 is sealed at the top by fixed inner and outer seals 292,294 and at the bottom by piston seal 257. The second chamber seals 292,294 are mounted to a seal ring 295 sandwiched between the upper and lower housing sections 231,232. The apparatus 18 includes a first and second hydraulic lines 297,299. The first hydraulic line 297 is provided for pumping hydraulic fluid into the chambers 263,264 below the piston 256 and the piston seal 257, the hydraulic fluid pressure acting on the lower surface 260, forcing the piston 256 upwards to the position shown in FIG. 7, where the fingers 240 are disengaged from the tubular 236.

To move the piston 256 downwards and permit the fingers 240 to pivot under their own weight towards the tubular 236, the hydraulic pressure is released from the first chamber 264 and hydraulic fluid is introduced into the second chamber 265, via the second hydraulic line 299, to act on the upper annular surface 258. The piston 256 then moves downwards, expelling hydraulic fluid from the first chamber 264.

Figure 10:
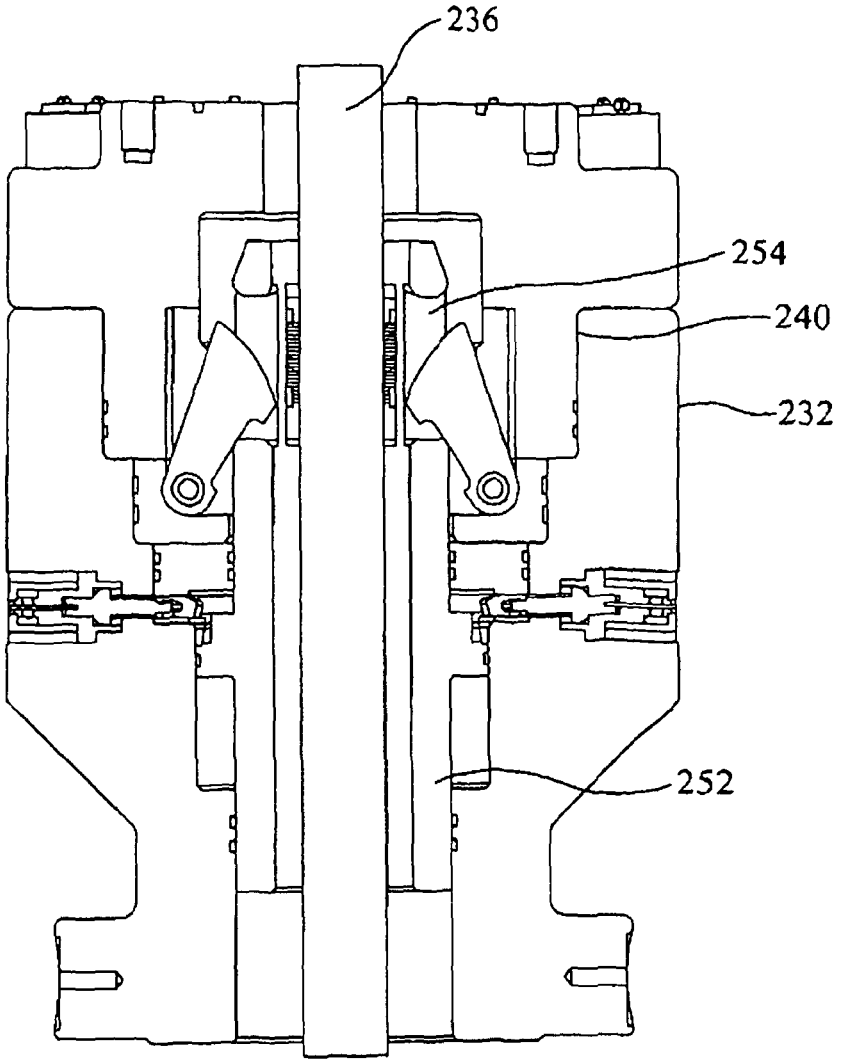
FIG. 10 is a section of the apparatus of FIG. 6 shown between the retracted and engaged configurations.

Referring now to FIG. 10, a section of the apparatus 18 between the retracted and engaged configurations, the piston 256 has started to descend under hydraulic pressure. As the piston apertures 254 are revealed to the fingers 240, the fingers 240 start to fall through the apertures 254 under their own weight. As the fingers 240 approach the engaged configuration, shown in FIG. 11, the upper edge 266 of each piston aperture 254 engages a back surface 268 of each finger 240, pushing the finger 240 into tighter engagement with the tubular 236 due to the hydraulic fluid being pumped into the chamber 264 above the flange 256 via the second hydraulic line.

The apertures 254 are designed to prevent lateral movement of the fingers 240 during contact with the tubular 236. This maximises the grip the fingers 240 apply to the tubular 236.

To prevent inadvertent movement of the fingers 240 from the retracted to engaged configuration by, for example downward movement of the piston 252 due to a failure in the first hydraulic line and a subsequent drop in hydraulic pressure on the underside 260 of the piston flange 256, a securing mechanism 270 is provided to maintain the piston 252 in the position shown in FIG. 7, that is with the fingers 240 in the retracted configuration.

Figure 8:
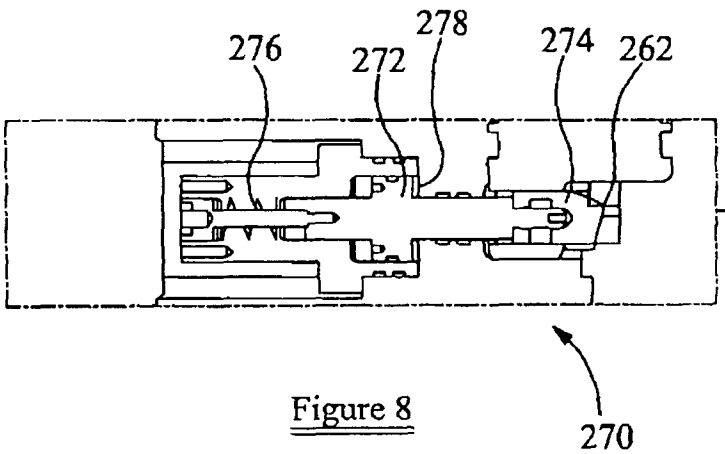
FIG. 8 is a close up view of the securing mechanism of FIG. 7 in a securing configuration.

The securing mechanism 270 is best seen in FIG. 8, a close-up view of the securing mechanism 270 of FIG. 7 in a securing configuration. The apparatus 18 comprises four securing mechanisms 270, each mechanism 270 comprising a hydraulic piston 272 attached to a dog 274. The dog 274 is shaped to fit in the flange recess 262. The mechanism piston 272 is maintained in the securing configuration shown in FIG. 7 by means of a spring 276 which biases the dog 274 into the flange recess 262. The securing mechanism 270 is linked to the second hydraulic line such that when hydraulic fluid is pumped into the piston chamber 264 above the flange 256, fluid is also pumped into a securing mechanism chamber 278 to move the piston 272 away from the flange recess 262 thereby freeing the aperture piston 252 to descend, shown most clearly in FIG. 11.

Figure 12:
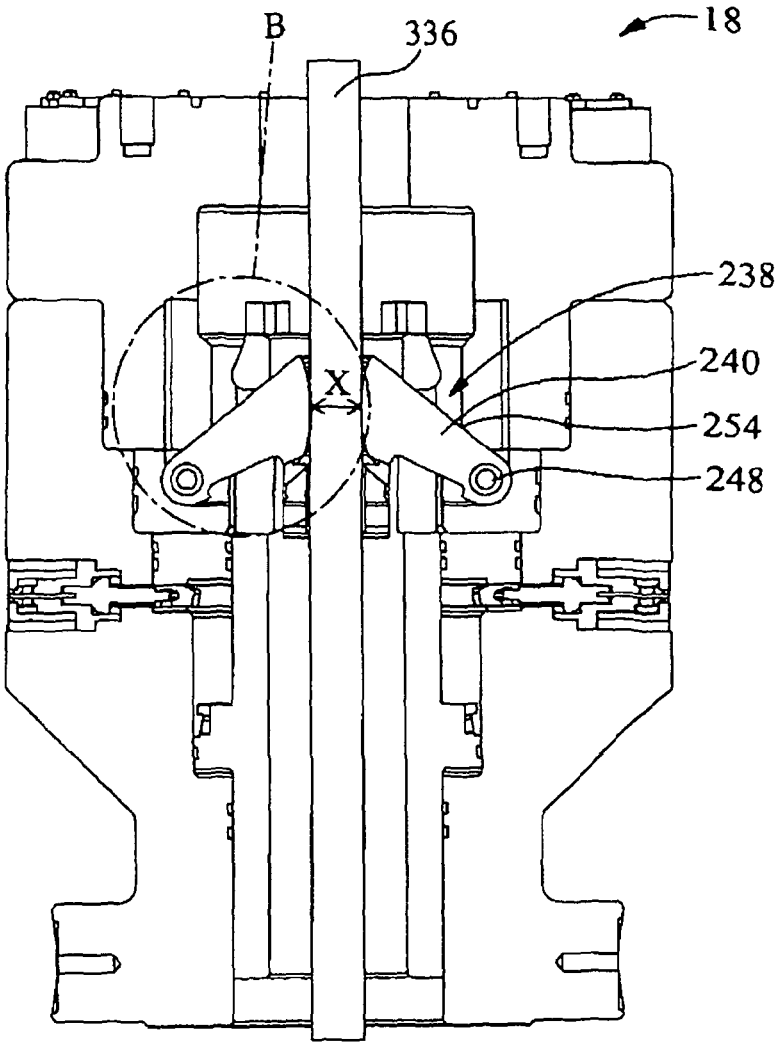
FIG. 12 is a section of the apparatus of FIG. 6 in the engaged configuration, shown engaged with a tubular having a diameter of 2.875 inches.
Figure 13:
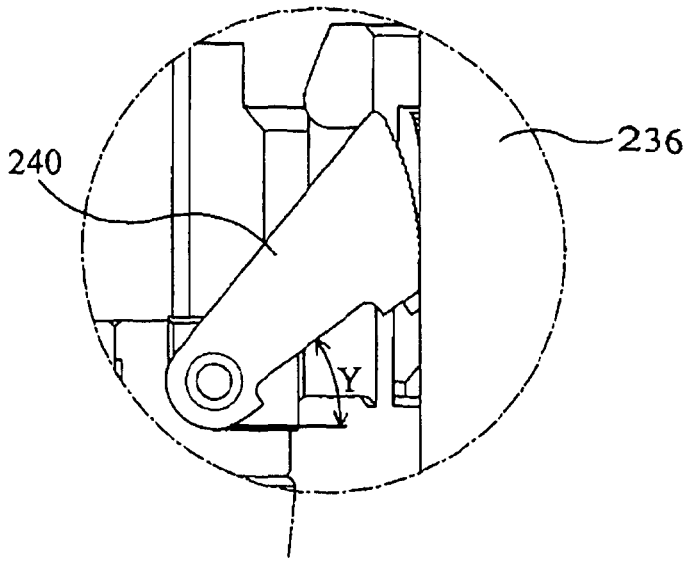
FIG. 13 is an enlarged view of the part of the apparatus marked "A" on FIG. 11.
Figure 14:
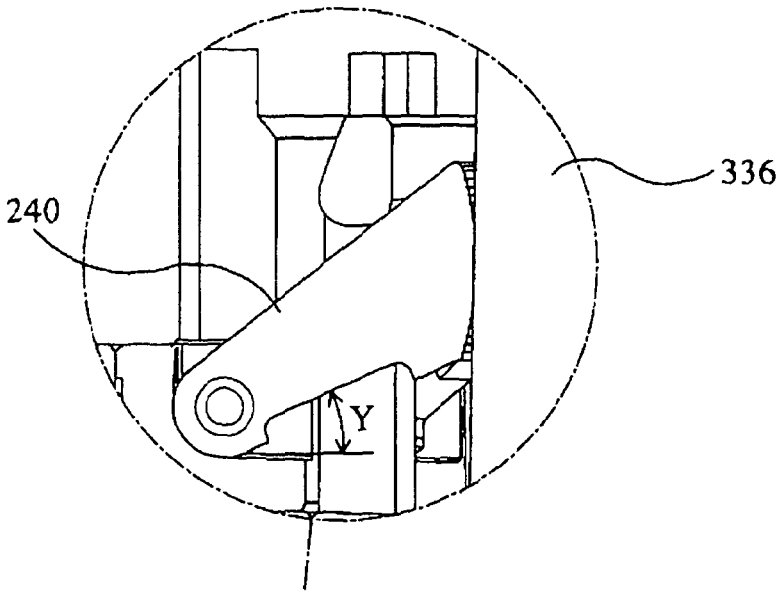
FIG. 14 is an enlarged view of the part of the apparatus marked "B" on FIG. 12.

Referring now to FIGS. 11 and 12, the engagement between the finger end surfaces 244 and the tubular 236 is a rolling engagement and, as such, as each finger 240 rolls about the pivots 248, the distance "X" between the finger end surfaces 244 reduces. Therefore, the apparatus 18 can be used with a number of different sizes of tubulars. The tubular 236 shown in FIG. 11 is a 4.5 inch diameter tubular, however as can be seen in FIG. 12 a tubular 336 of reduced diameter, in this case 2.875 inches, can also be gripped and supported. FIGS. 13 and 14 show enlarged views of the fingers 240 of part of the apparatus 18 marked "A" on FIG. 11 (FIG. 13) and marked "B" on FIG. 12 (FIG. 14). As can be seen with the narrower diameter tubular 336 in FIG. 14, the angle "Y" of the fingers 240 to the horizontal is less than for the broader diameter tubular 236 in FIG. 13, permitting the tubular 336 to be gripped by the fingers 240.

Referring back to FIG. 3, the first and second lower annular seals 16, 14 are activated and engaged with the lower drill string portion 132 in order to seal the annulus 136.

Once the blow-out preventer rams 68-74 are closed, the well is contained. To recover control of the well, the marine riser 26 and emergency disconnect package 24 are lowered back down and latched onto the lower latch portion 78. The emergency disconnect package rams 102, 104 are opened and heavy fluid is then pumped from surface down the upper drill string portion 134 into a void 138 above the blow out preventer rams 68-74. When sufficient hydrostatic pressure has been developed in the fluid above the blow-out preventer 20 to overcome the pressure in the well below the rams 68-74, the blow-out preventer rams 68-74 are opened allowing the heavy fluid into the void 142 below the blow-out preventer 20. As the second lower annular seal 16 seals against pressure from above, the heavy fluid flows through the open end 144 of the lower downhole tubular portion 132 into the lower downhole tubular portion 132 to regain control of the well.

As the heavier fluid flows down the lower drill string portion 132, the pressurised return fluid in the annulus 136 is fed through the choke line 30 to the subsea choke 32 where the pressure is reduced to a level that can be accommodated by the low pressure riser 26 and the depressurised fluid flows from the subsea choke 32 into the riser 26 via the choke outlet 38 and back to surface.

This process continues until the situation in which the hydrostatic pressure is greater than the well pressure has been restored. At this point the return fluid is not pressurised by the well.

Figure 4:
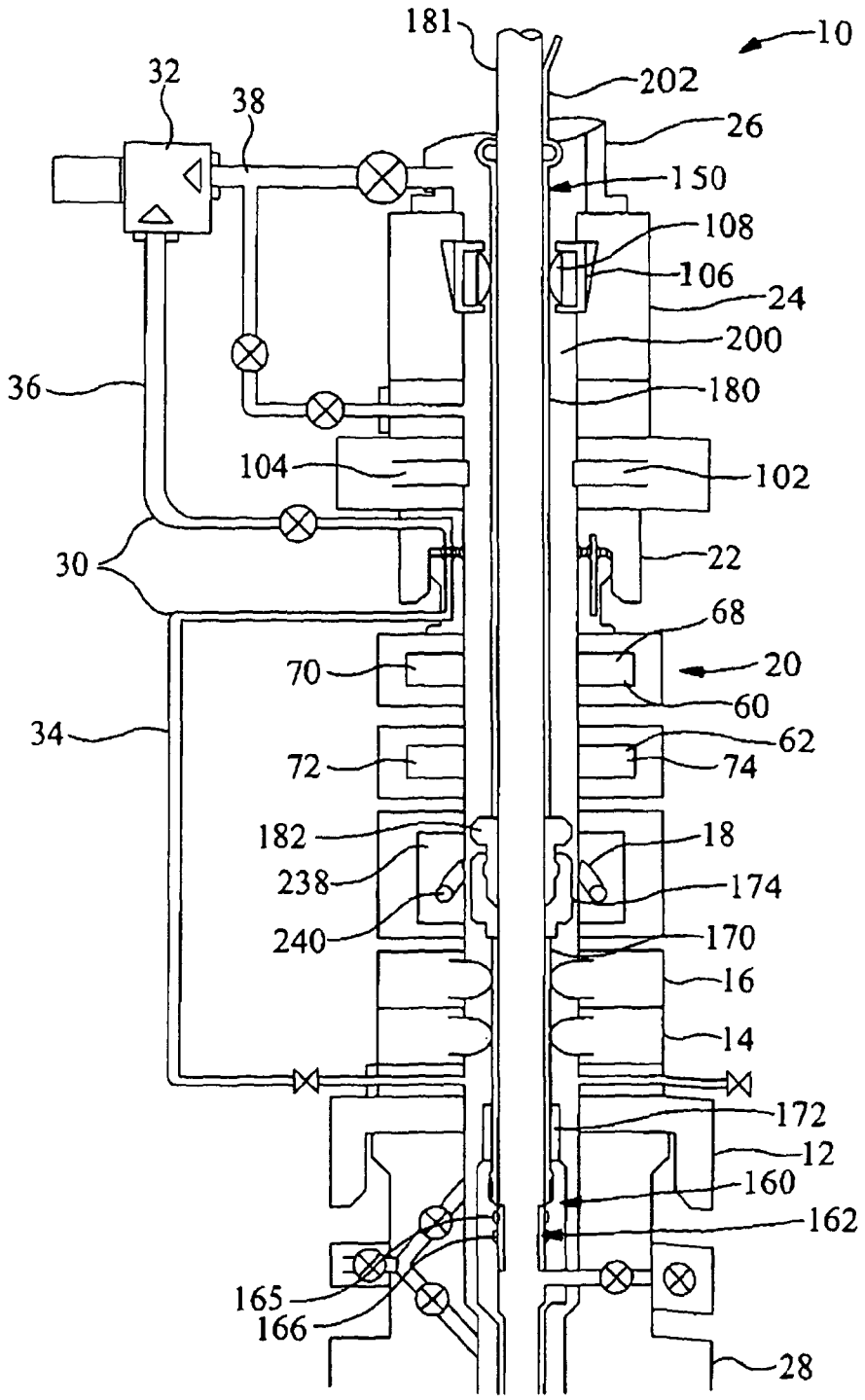
FIG. 4 is a section of the well containment system of FIG. 1 during a tubing hanger deployment operation.

Referring now to FIG. 4, during completion operations a tubing hanger 160 is installed within the wellhead.

FIG. 4 shows the landing string 200 in tubing hanger deployment mode. The landing string 200 comprises, from bottom up: a tubing hanger running tool 172, which engages the tubing hanger 160; a lower ported slick joint (LPSJ) 170; a latch receptacle 174 and a latch pin 182. The latch pin 182 is fitted to an upper ported slick joint (UPSJ) 180. The UPSJ 180 is connected to plain tubing 181 and an umbilical bundle 202 is strapped to the landing string 200. At its lowest end the umbilical bundle 202 breaks out into individual cores for connection to discrete ports at the top of the UPSJ 180. At the upper end the umbilical is connected to the work-over control panel (not shown).

Figure 5:
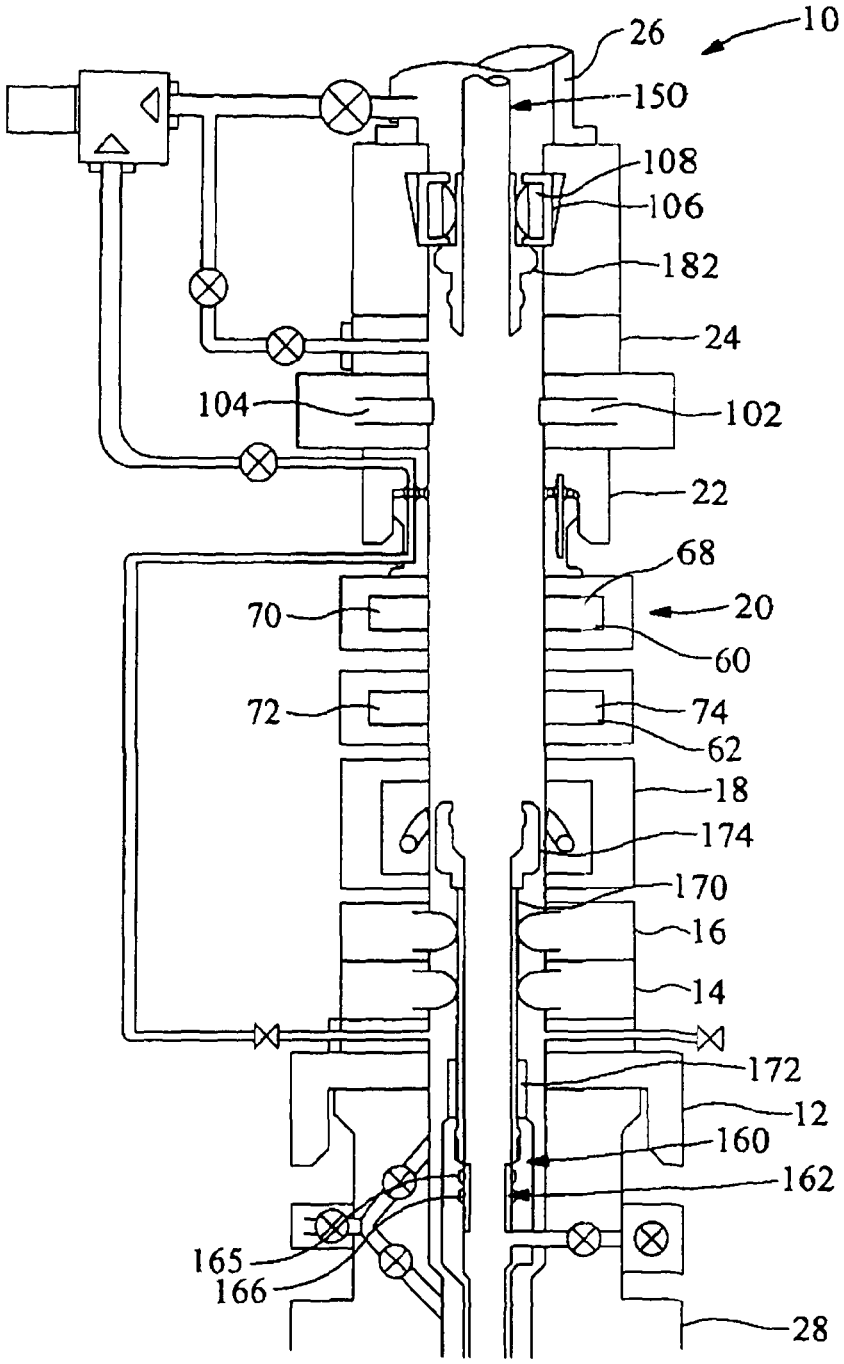
FIG. 5 is a section of the well containment system of FIG. 1 during a normal work over operation.

In the connected configuration, shown in FIG. 4, umbilical pathways for the control fluids are intact allowing operation of the requisite functions to lock the tubing hanger 160 into position in the Christmas tree 28, and facilitate the disconnection of the latch 182 in preparation for separation of the landing string 200 as shown in FIG. 5. A wear sleeve 162 is fitted into the tubing hanger 160 to prevent the production plug recesses 164, 166 from being damaged by subsequent operations.

The latch pin 182 is disconnected from the latch receptacle 174 and withdrawn to the position shown in FIG. 5. The inwardly acting seals 14, 16, 106 are then activated and the well can be opened by opening a downhole valve (not shown). Once the downhole valve is opened, a work over operation can take place in which tooling may be introduced into the well suspended on wireline, coiled tubing or drill pipe.

In this arrangement, there is a gap between the latch pin 182 and the latch receptacle 174. The well containment system 10 is designed such that the latch pin 182 is above the emergency disconnect package rams 102, 104 and the latch receptacle 174 is below the blow-out preventer rams 68-74. This means that when a tool string is operating downhole, being controlled from surface and passing through the well containment system 10 and a potential blow-out arises, the blow-out preventer rams 68-74 can be shut and only have sever through the tool string to secure the well.

Figure 3:
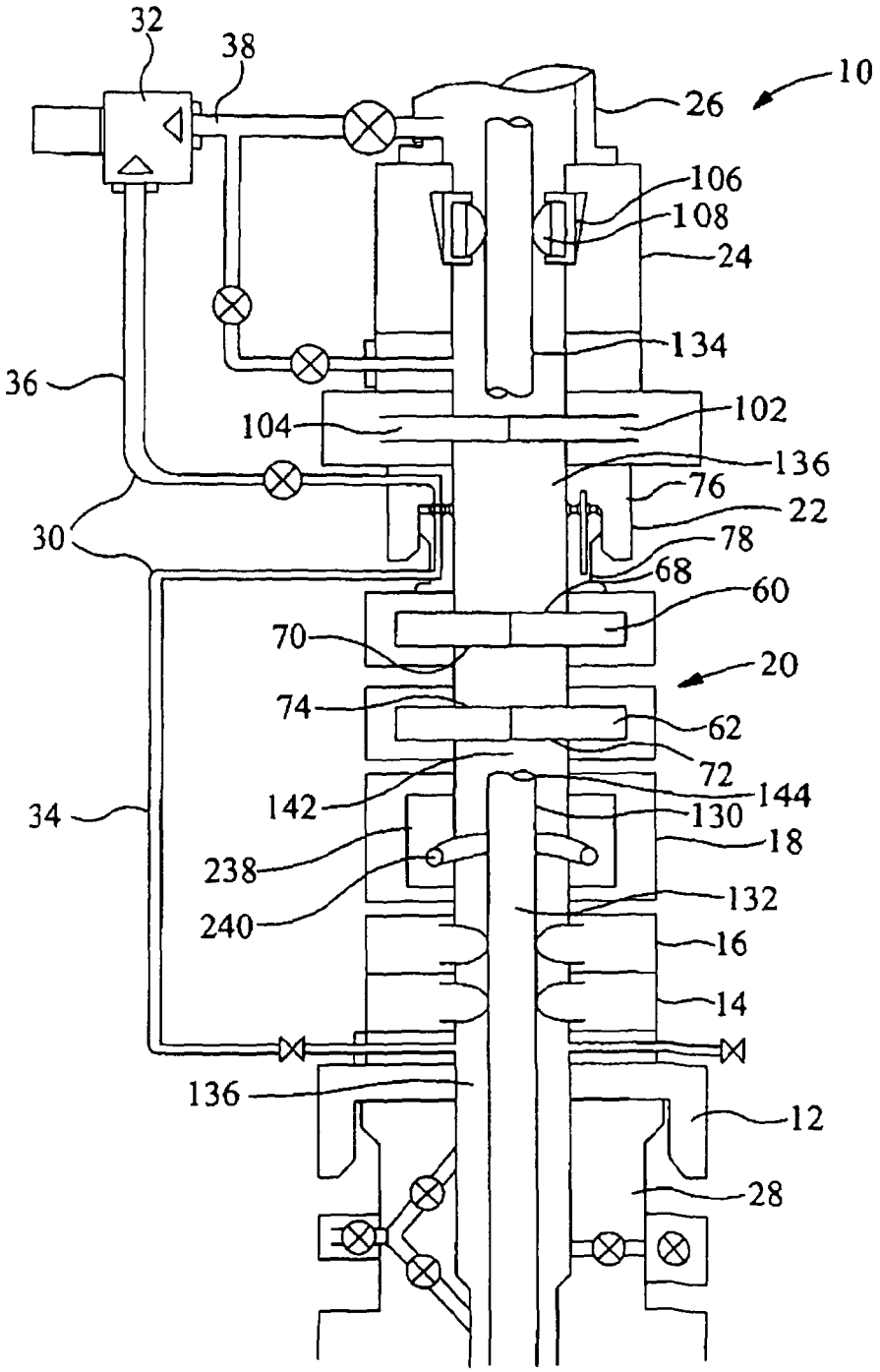
FIG. 3 is a section of the well containment system of FIG. 1 after closure of the blow out preventer and prior to an emergency disconnect situation.

As with the situation shown in FIG. 3, to regain control of the well fluid pressure can be built up above the BOP rams 68-74, before the rams 68-74 are opened and the hydrostatic pressure of the fluid then enters the downhole tubular 170 and the well to counteract the effect of the well pressure.

In a further mode of operation, in the event of a kick being experienced, particularly on a well in which there is a high proportion of gas, it may be desirable to minimize the volume of gas within the marine riser 26.

Providing a side outlet 500 (FIG. 1) close to the underside of the upper annular sealing mechanism 106 offers the possibility for leading gas which has broken out of solution to surface via a separate conduit. The gas break-out rate is likely to be enhanced by reducing the pressure. This may be achieve by the addition of an empty pressure vessel (not shown), rated to withstand the ambient subsea pressure which, initially, has a low internal pressure.

Allowing the pressurised fluid into this empty pressure vessel has the effect of dropping its pressure and may improve the rate of gas break-out. This forms the basis of a simple subsea system which separates gases from liquids.

Various modifications and improvements may be made to the above described embodiments without departing from the scope of the invention. For example the gripping mechanism could comprise a number of slips moveable slips which are displaced radially inwards by moving in an axial direction over a camming surface. Although the gripping mechanism is described as having six gripping fingers, there may be four or alternatively seven or any suitable number of fingers. In other embodiments there may only be one set of BOP rams, or more than two sets of BOP rams. In further alternative embodiments the choke outlet line may run directly into the emergency disconnect package rather than the marine riser, or may run to surface alongside the marine riser.

The invention claimed is:

1. A well containment system comprising:

a blow out preventer, the blow out preventer defining a throughbore and including at least one well containment barrier adapted to seal the throughbore;

an emergency disconnect package located between a lower end of a riser and the blow out preventer, the emergency disconnect package comprising:

at least one first seal adapted to seal against the lower end of an upper portion of a downhole tubular; and at least one ram set adapted to close and seal the throughbore; and the well containment system further comprising at least one second seal adapted to seal against the upper end of a lower portion of the downhole tubular, wherein the at least one second seal is an annular seal, and wherein the at least one first seal is located above the at least one well containment barrier and the at least one second seal is located below the at least one well containment barrier.

2. The well containment system of claim 1, wherein, in use, the upper end of the lower portion of the downhole tubular is located below the well containment barrier.

3. The well containment system of claim 1, wherein, in use, the lower end of the riser is located above the well containment barrier.

4. The well containment system of claim 1, wherein the/each well containment barrier comprises at least one shearing mechanism adapted to shear a tubular.

5. The well containment system of claim 1, wherein the/each well containment barrier comprises at least one ram adapted to seal the blow out preventer throughbore.

6. The well containment system of claim 5, wherein the/each well containment barrier comprises a pair of rams.

7. The well containment system of claim 1, wherein there is a plurality of well containment barriers.

8. The well containment system of claim 7, wherein, where there is a plurality of well containment barriers, the at least one first seal is located above the uppermost well containment barrier.

9. The well containment system of claim 7, wherein, where there are a plurality of well containment barriers, the at least one second seal is located below the lowest well containment barrier.

10. The well containment system of claim 7, wherein there is an upper well containment barrier and a lower well containment barrier.

11. The well containment system of claim 10, wherein the at least one first seal is located above the upper well containment barrier.

12. The well containment system of claim 10, wherein the at least one second seal is located below the lower well containment barrier.

13. The well containment system of claim 1, wherein the at least one first seal is an annular seal.

14. The well containment system of claim 1, wherein the at least one first seal comprises a seal element adapted to move between a retracted position and a sealing position in which, in use, the seal element is sealed against the lower end of the upper portion of the downhole tubular.

15. The well containment system of claim 14, wherein the seal element is adapted to move radially inwardly between the retracted and sealing positions.

16. The well containment system of claim 1, wherein there is a plurality of first seals.

17. The well containment system of claim 1, wherein the at least one second seal comprises a seal element adapted to move between a retracted position and a sealing position in which, in use, it is sealed against the upper end of the lower portion of the downhole tubular.

18. The well containment system of claim 17, wherein the seal element is adapted to move radially inwardly between the retracted and sealing positions.

19. The well containment system of claim 17, wherein the seal element is adapted to withstand pressure from above and below.

20. The well containment system of claim 1, wherein there is a plurality of second seals.

21. The well containment system of claim 20, wherein at least one of the plurality of second seals is adapted to withstand pressure from below.

22. The well containment system of claim 20, wherein at least one of the plurality of second seals is adapted to withstand pressure from above.

23. The well containment system of claim 1, wherein each of the at least one first and at least one second seal comprises a housing.

24. The well containment system of claim 23, wherein the housing defines an opening.

25. The well containment system of claim 24, wherein the at least one first and/or the at least one second seal is adapted to inflate or expand through the opening.

26. The well containment system of claim 24, wherein the opening faces into the well containment system throughbore.

27. A well containment system comprising:

a blow out preventer, the blow out preventer defining a throughbore and including at least one well containment barrier adapted to seal the throughbore;

an emergency disconnect package located between a lower end of a riser and the blow out preventer, the emergency disconnect package comprising:

at least one first seal adapted to seal against the lower end of an upper portion of a downhole tubular; and at least one ram set adapted to close and seal the throughbore; and the well containment system further comprising at least one second seal adapted to seal against the upper end of a lower portion of the downhole tubular, and wherein the at least one first seal is located above the at least one well containment barrier and the at least one second seal is located below the at least one well containment barrier, the well containment system further comprising a gripping apparatus for gripping the upper end of the lower portion of the downhole tubular, the gripping mechanism being moveable between a retracted, non-engaged configuration and an engaged configuration, the gripping mechanism, in use, applying a gripping force to the tubular when in said engaged configuration.

28. The well containment system of claim 27, wherein the gripping apparatus is located below the at least one well containment barrier.

29. The well containment system of claim 27, wherein, where there are a plurality of well containment barriers, the gripping apparatus is located below the lowest well containment barrier.

30. The well containment system of claim 27, wherein the gripping mechanism is rotationally moveable between the non-engaged and engaged configurations.

* * * * *